US005986192A

United States Patent [19]

Wingfield et al.

[11] Patent Number: 5,986,192

[45] Date of Patent: Nov. 16, 1999

[54] LOCKING DEVICE FOR TREMOLO SYSTEMS FOR STRINGED INSTRUMENTS

[75] Inventors: David A. Wingfield, Frankfort; Bryan J. McLaughlin, Old Forge, both of N.Y.

[73] Assignee: Arthur Neil Corporation, Frankfort, N.Y.

[21] Appl. No.: 09/188,280

[22] Filed: Nov. 9, 1998

Related U.S. Application Data

[60] Provisional application No. 60/086,292, May 21, 1998.

[51] Int. Cl.[6] ..... G10D 3/00

[52] U.S. Cl. ..... 84/313; 84/453

[58] Field of Search ..... 84/267, 290, 307, 84/313, 453

[56] References Cited

U.S. PATENT DOCUMENTS

| | | | |
|---|---|---|---|
| 3,248,991 | 5/1966 | Cole | 84/313 |
| 4,643,070 | 2/1987 | Petrillo | 84/313 |
| 4,688,461 | 8/1987 | Stroh | 84/298 |
| 4,697,493 | 10/1987 | Ralston | 84/313 |
| 4,724,737 | 2/1988 | Fender | 84/313 |
| 4,763,555 | 8/1988 | Minakuchi et al. | 84/313 |
| 4,852,448 | 8/1989 | Hennessey | 84/313 |
| 4,882,967 | 11/1989 | Rose | 84/313 |
| 4,892,025 | 1/1990 | Steinberger | 84/313 |
| 5,311,804 | 5/1994 | Wilkinson | 84/313 |
| 5,522,298 | 6/1996 | Schaller et al. | 84/313 |

FOREIGN PATENT DOCUMENTS

| | | |
|---|---|---|
| 56-75793 | 6/1991 | Japan . |

*Primary Examiner*—Robert E. Nappi
*Assistant Examiner*—Wesley Scott Ashton
*Attorney, Agent, or Firm*—Trapani & Molldrem

[57] ABSTRACT

A tremolo locking device for an electric guitar or similar stringed instrument has a lower part that is fastened to the guitar body and an upper part that can be pivoted by use of the guitarist's fingers into or out of engagement with an edge of the tremolo base plate. The upper part can have a threaded barrel member into which a knurled screw is adjustable to establish a gap or recess that engages the base plate.

7 Claims, 3 Drawing Sheets

LOCKING DEVICE FOR TREMOLO SYSTEMS FOR STRINGED INSTRUMENTS

This application claims benefit of provisional application No. 60,086,292 filed May 21, 1998.

BACKGROUND OF THE INVENTION

This invention relates to musical instruments, and in particular to stringed instruments such as electric guitars having a tremolo bar. The invention is more specifically concerned with a tremolo stop device that permits the performer to enable or disable the tremolo feature of his or her instrument during performance and without interfering with the playing of the instrument.

Many modern electric guitars are fitted with a tremolo attachment mounted in the body of the guitar. The body ends of the guitar strings are mounted on a tremolo plate which is mounted in the guitar body for pivoting. A system of adjustable springs tensions the tremolo plate to balance the tension of the guitar strings. The player moves a tremolo bar, or lever, that is attached to the tremolo plate to change the tension on the strings, and thus to change the pitch of the notes, i.e., to "bend" the notes. Guitars with tremolo attachments are well known and several are described, for example, in U.S. Pat. No. 4,892,025 to Steinberger, in U.S. Pat. No. 4,852,448 to Hennessey, and in U.S. Pat. No. 5,522,298 to Schaller et al. For some musical selections, it is required that the performer employ the tremolo feature, and for other selections it is required not to use the tremolo feature. There are instances where there are some passages that require tremolo, and other sections or passages where tremolo would not be used. Unfortunately, when tremolo is not needed, the tremolo system is still "active" and can change the pitch of the strings even when not desired. Also tremolo systems provide some problems for guitarists. Some string bends cannot always be played in tune. If a string breaks, the instrument is rendered unplayable on the remaining strings, because the loss of string tension upsets the equilibrium necessary for proper tuning and proper function of the tremolo. Players cannot rest their hands firmly on the bridge, as they are inclined to do, because this also upsets the equilibrium of the tremolo. For these reasons, guitarists have needed a simple, effective tremolo lock that permits the guitar to be changed over easily between a tremolo mode and a normal or non-tremolo mode. There have been various proposals to lock the tremolo arm of a tremolo attachment, involving turning or twisting the tremolo arm or lever one way to lock the tremolo attachment and to turn it the other way to unlock it. Two of these are described in U.S. Pat. No. 5,311,804 to Wilkinson and in U.S. Pat. No. 4,697,493 to Ralston. These locking mechanisms tend to be large and cumbersome, and can make the playing of the guitar somewhat more difficult. It is also difficult for the guitarist to change over between the tremolo and non-tremolo while continuing to play the guitar. In particular, the industry has failed to provide a tremolo locking device mounted unobtrusively on the front of the guitar body and which can be easily engaged and disengaged while playing the guitar.

OBJECTS AND SUMMARY OF THE INVENTION

Accordingly, it is an object of the invention to provide a guitar tremolo locking device that avoids the drawbacks of the prior art, and which is unobtrusive, simple to install and to use, and which does not affect the appearance of the instrument.

It is another object to provide a guitar tremolo lock that can be after-fitted on an existing electric guitar, and can be easily adjusted by the user.

It is a further object to provide a finger-operated tremolo locking device for an electric guitar or similar stringed instrument for selectively disabling the tremolo feature.

According to an aspect of this invention, a tremolo locking device is provided for an electric guitar or other stringed instrument of the type having a body and a plurality of tensioned strings. A tremolo attachment for the instrument includes a tremolo plate situated in the guitar body, and one end of the tensioned strings is anchored to the tremolo plate. A pair of pivot screws or similar means on the body pivotally engage the neck side of the tremolo plate. A counterspring arrangement extends between a portion of the tremolo plate and the guitar body for balancing against tension of the strings. A tremolo arm mounted on the tremolo plate permits the guitarist to pivot the plate while he or she is playing the guitar, and thus vary the string tension, and hence the pitch. In order to select between an enabled and disabled condition for the tremolo attachment, the guitar is provided with a tremolo locking device. The tremolo locking device has a lower member and an upper member that are hinged to one another. The lower member is affixed onto the guitar body adjacent an edge of the tremolo plate, and the upper member is mounted for pivotal motion on the lower member. The upper member includes means defining a recess, i.e., a race or groove, to engage a rim of the tremolo plate, such that the upper member can be swung into engagement with the tremolo plate to lock same against movement and can be swung out of engagement therewith to permit movement of the tremolo plate. Preferably the upper member has a threaded barrel member, and a threaded screw member with a threaded shaft engages the threaded barrel member. The screw member has a head that serves to define the recess that engages said tremolo plate. The tremolo locking device can also include a set of one or more threaded nuts, so that the means that defines the recess includes the head of the threaded screw member and the one or more threaded nuts situated on the shaft between the barrel member and head.

In one preferred embodiment, the hinge portion of the tremolo lock device is arranged transversely, i.e., parallel to the body of the guitar, so that the upper member swings up to engage the plate and down to disengage. In other embodiments the device could pivot about an axis normal to the body of the guitar, and swing in and out to engage or disengage. In either event, the locking device can be operated with the guitarist's hand while playing the guitar, so that tremolo can be enabled or disabled on the fly, i.e., during active performance. Also, the construction of the tremolo locking device permits it to be small and unobtrusive, so that it does not affect the visual appearance of the instrument, nor does its weight and size affect the handling of the instrument.

The above and many other objects, features, and advantages of this invention will become apparent to persons skilled in the art from the ensuing description of a preferred embodiment, which should be considered in connection with the accompanying Drawing.

DETAILED DESCRIPTION OF A PREFERRED EMBODIMENT

Figure 1:
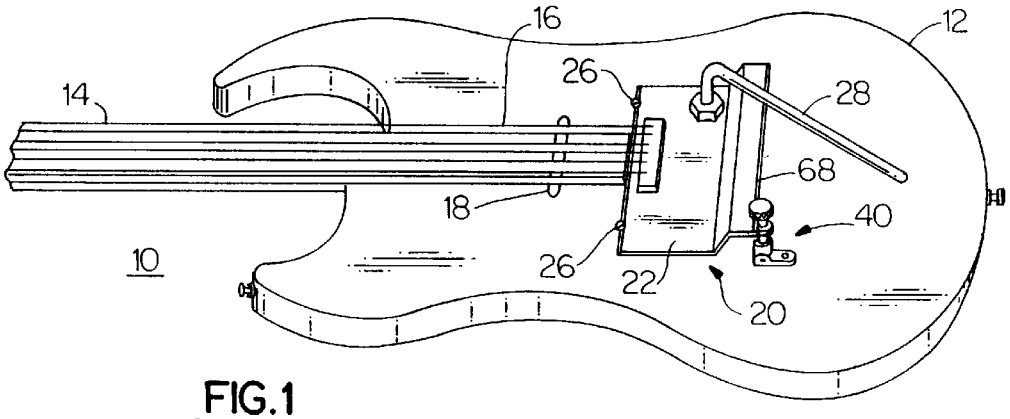
FIG. 1 is a perspective view of an electric guitar with a tremolo attachment, and incorporating a tremolo lock according to one embodiment of this invention.

With reference to the Drawing, and initially to FIG. 1 thereof, a typical electric guitar 10 is shown, having a body 12, usually of wood, and a neck 14. As is usual, there are six strings 16 stretched from the head (not shown) of the guitar, over the length of the neck 14 and anchored on the guitar body 12. An electric pickup 18 is shown on the body below the strings.

In this guitar 10 there is a tremolo attachment 20 fitted into the body 12. This is in the form of a pivotable base plate 22 with an anchor 24 on the top surface to which the lower ends of the strings 16 are anchored. A pair of pivot screws 26 are fastened into the guitar body and position against the upper side edge of the base plate 22. These define a fulcrum at which the tremolo base plate 22 is permitted to pivot up and down. The guitarist moves a tremolo bar or lever 28, which is attached to the base plate 22, to move the tremolo base plate and change the pitch of the strings 16.

Figure 2:
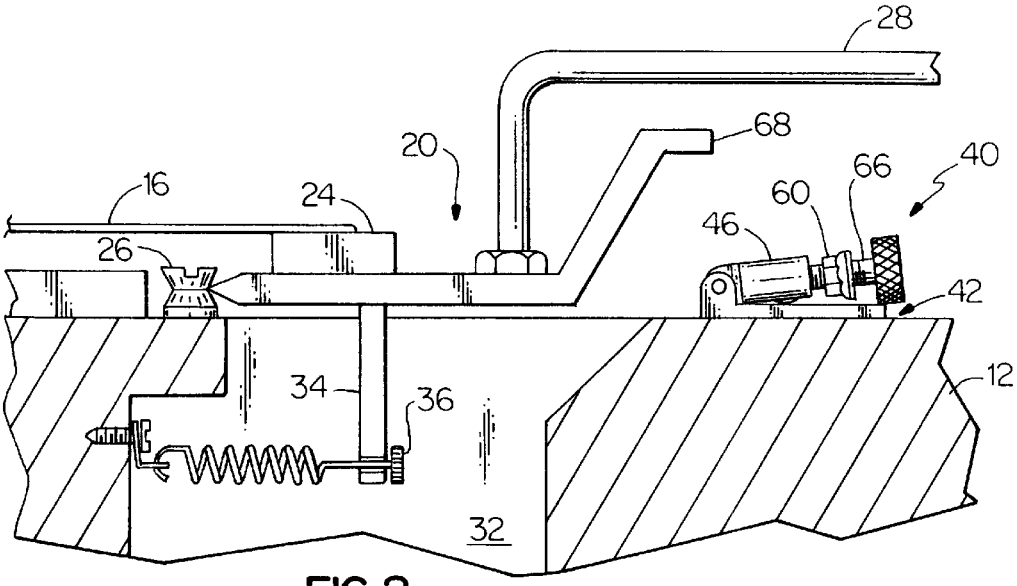
FIGS. 2 and 3 are schematic sectional views showing the tremolo attachment and tremolo lock of the embodiment of FIG. 1 in a disengaged and in an engaged position, respectively.

As better shown in FIG. 2, a counterspring arrangement 30 balances against the string tension imposed on the tremolo base plate 22 by the strings 16. This arrangement 30 includes one or more springs positioned in a recess 32 within the body 12, that have one end affixed to the guitar body 12 and another end attached to a pylon 34 formed on the base plate 22. An adjusting screw 36 allows adjustment of counterspring tension at the pylon end of the springs.

Figure 3:
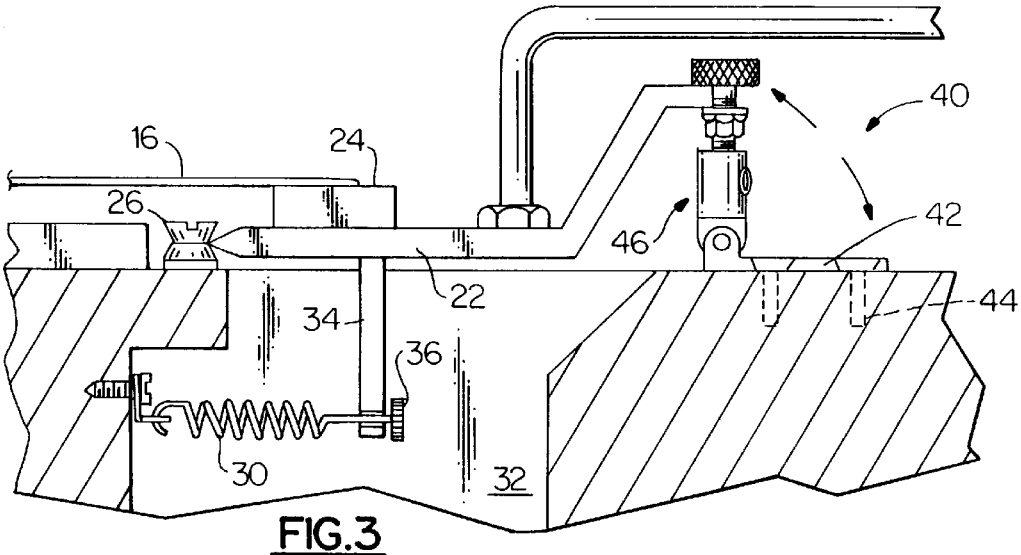

As mentioned before, even when the guitarist has his hands away from the tremolo bar 28, the tremolo feature is still "active," and can affect the tuning of the strings 16. For that reason, a tremolo lock device 40 is provided to hold the tremolo base plate 22 steady when the guitarist does not want a tremolo effect. However, this device 40 can be quickly moved out of the way to permit tremolo when it is desired. As shown in FIG. 2, the tremolo lock device 40 is out of engagement, i.e., in a lowered or swung down position. As shown in FIG. 3, the tremolo lock device 40 of this embodiment can swing up to engage an edge of the base plate 22 and disable the tremolo feature.

Figure 5:
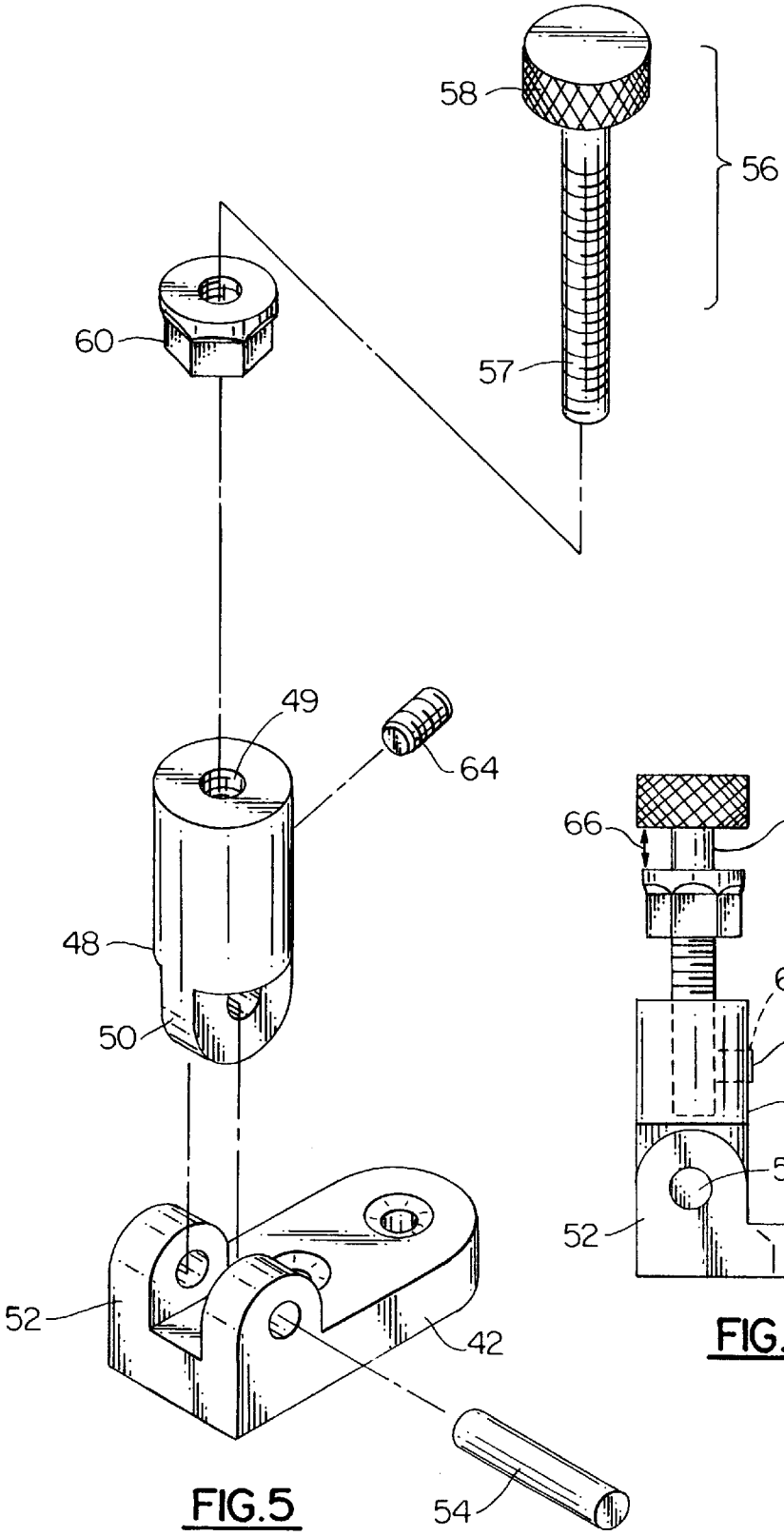
FIG. 5 is an exploded view of the tremolo stop of this embodiment.
Figure 4:
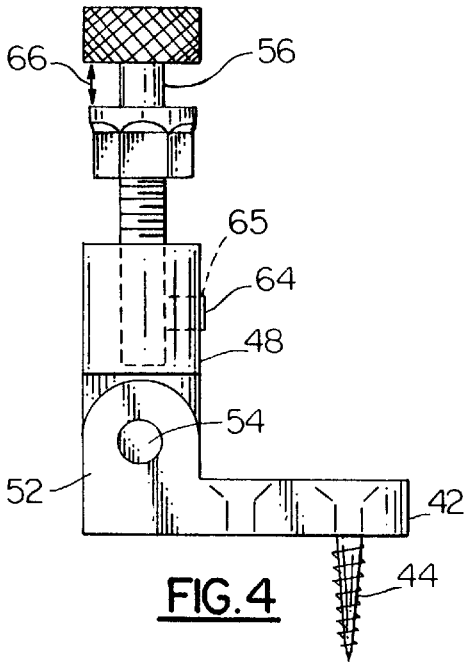
FIG. 4 is an elevation of the tremolo lock of this embodiment.

As better shown in the enlarged view of FIG. 4 and the exploded view of FIG. 5, the device 40 has a lower hinge member 42 which is attached by means of wood screws 44 to the top of the guitar body 12. An upper member 46 includes an assembly based on a barrel member 48. The barrel member has a threaded bore 49 at its upper end and a hinge eye 50 at its lower end. The hinge eye 50 aligns with a hinge eye 52 of the lower member 42, and the two are joined with a pivot pin 54 to define a transverse pivot axis.

An adjustable screw member 56 has a shaft or post 57 and a knurled head 58. The shaft 57 mates with the threaded bore 49. A nut 60 rides on the shaft 57 and is rotatable to move up and down on the shaft. A set screw 64 fits into a bore 65 in the barrel member 48 to lock the screw member 56 into a desired position. The head 58 of the screw member and the top surface of the first nut 60 define a gap 66, that is, a race or groove that interlocks with a front edge 68 of the tremolo base plate 22. The location and width of the gap 66 are adjustable. With the set screw 64 turned out, the combination of parts including screw member 56 and nut 60 is freely movable up and down. The space or gap 66 is adjusted by means of the nut 60 until the width between the nut 60 and the head 58 is proper. Then the screw member 56 is rotated up or down to effect height adjustment. Once height adjustment is made, the set screw 64 locks the assembly in place.

The upper member can be swung into place with the guitarist's fingers while he or she is playing the guitar to lock the tremolo plate 22 or to unlock it. The device 40 is easily and quickly engaged and disengaged. The device 40 is small and unobtrusive, and does not detract from the guitar's appearance. Also, because of its small size and small weight, it does not get in the way of playing, and does not affect the feel of the guitar. Also, when the lock is applied, the instrument tuning is unaffected, and will remain in tune relative to the instrument when the tremolo lock is disengaged.

Figure 6:
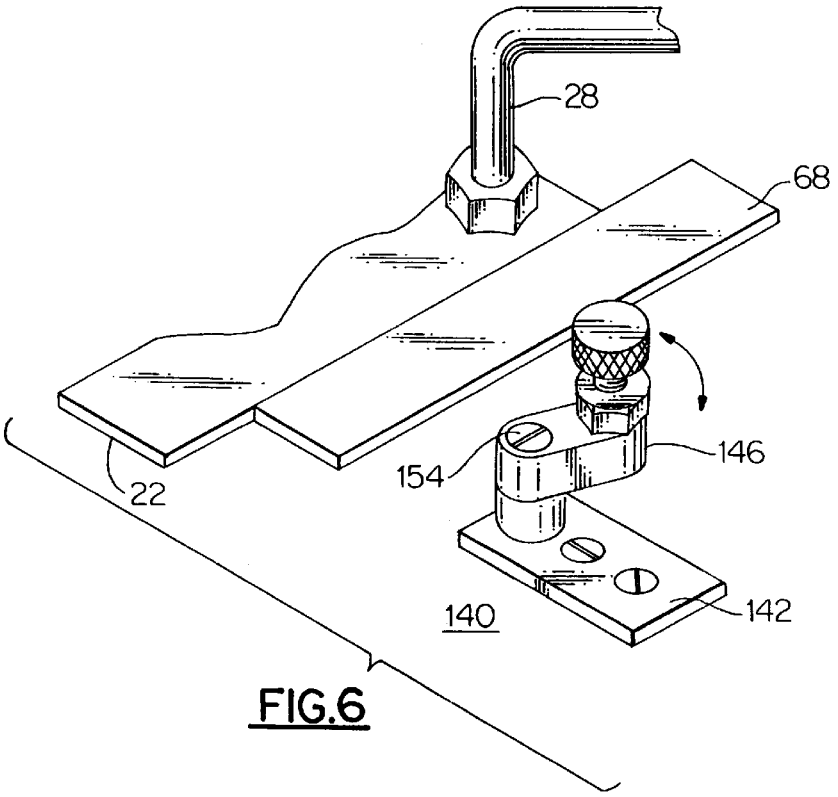
FIG. 6 shows an alternative embodiment.

An alternative arrangement of the tremolo lock device 140 is illustrated in FIG. 6. Here an upper member 146 is joined to a lower member 142 by means of a vertical pivot pin 154, so that the device has a pivot axis that is normal to the body of the guitar. In this embodiment, the device swings in and out, rather than up and down, to engage the tremolo base plate 22. Other embodiments are also possible. For example, there can be a pair of nuts instead of the single nut 60. Also, the device of these embodiments can be adapted to fit other tremolo systems. Further, while not shown here, the device 40 can have a snap action between its engaged and disengaged positions, so that it remains engaged or disengaged, as desired, without disturbing the performer.

Figure 7:
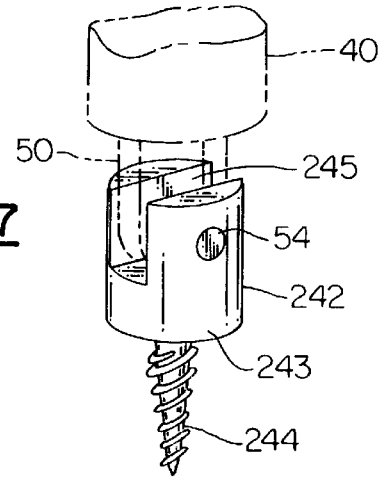
FIG. 7 is a perspective view of a portion of another alternative embodiment.

Another alternative embodiment is shown in FIG. 7, which can be the same as the first embodiment, with the exception of the lower hinge member 42. There the lower hinge member 242 is in the form of a screw having a slotted, canister shaped head 243, and a threaded shaft 244 that is secured into the guitar body. The hinge eye 50 of the associated barrel member 48 is held in place in a slot 245 by means of the pivot pin 54.

While the invention has been described in reference to a preferred embodiment, it should be understood that the invention is not limited to that precise embodiment. Rather, many modifications and variations will present themselves to those skilled in the art without departing from the scope and spirit of the invention, as defined in the appended claims.

We claim:

1. A tremolo locking device for a stringed instrument of the type having a body, a plurality of tensioned strings, a tremolo plate situated in the body and including means thereon for anchoring one end of said tensioned strings; pivot means on said body for pivotally engaging said tremolo plate; counterspring means extending between a portion of said tremolo plate and said body for balancing against tension of said tensioned strings; and a tremolo arm mounted on said tremolo plate to permit a performer using said instrument to pivot said plate and thus vary the tension on said strings;

said tremolo locking device comprising;

a lower member affixed onto said body adjacent an edge of said tremolo plate, and an upper member mounted for pivotal motion on said lower member, and including means defining a recess therein adapted to engage a rim of said tremolo plate and hold the tremolo plate against upward and downward movement, such that the upper member can be swung into engagement with the tremolo plate to lock said tremolo plate against upward and downward movement and can be swung out of engagement therewith to permit movement of the tremolo plate.

2. A tremolo locking device for a stringed instrument of the type having a body, a plurality of tensioned strings, a tremolo plate situated in the body and including means thereon for anchoring one end of said tensioned strings; pivot means on said body for pivotally engaging said tremolo plate; counterspring means extending between a portion of said tremolo plate and said body for balancing against tension of said tensioned strings; and a tremolo arm mounted on said tremolo plate to permit a performer using said instrument to pivot said plate and thus vary the tension on said strings;

said tremolo locking device comprising;

a lower member affixed onto said body adjacent an edge of said tremolo plate, and an upper member mounted for pivotal motion on said lower member, and including means defining a recess therein to engage a rim of said tremolo plate, such that the upper member can be swung into engagement with the tremolo plate to lock said tremolo plate against movement and can be swung out of engagement therewith to permit movement of the tremolo plate;

wherein said lower member has a hinge eye therein, and said upper member has a hinge eye joined to the lower portion hinge eye by means of a pivot pin.

3. A tremolo locking device for a stringed stringed instrument of the type having a body, a plurality of tensioned strings, a tremolo plate situated in the body and including means thereon for anchoring one end of said tensioned strings; pivot means on said body for pivotally engaging said tremolo plate; counterspring means extending between a portion of said tremolo plate and said body for balancing against tension of said tensioned strings; and a tremolo arm mounted on said tremolo plate to permit a performer using said instrument to pivot said plate and thus vary the tension on said strings;

said tremolo locking device comprising;

a lower member affixed onto said body adjacent an edge of said tremolo plate, and an upper member mounted for pivotal motion on said lower member, and including means defining a recess therein to engage a rim of said tremolo plate, such that the upper member can be swung into engagement with the tremolo plate to lock said tremolo plate against movement and can be swung out of engagement therewith to permit movement of the tremolo plate;

wherein said upper member includes a threaded barrel member, a threaded screw member having a threaded shaft that engages the threaded barrel member, and having a head that serves to define said recess that engages said tremolo plate.

4. The tremolo locking device according to claim 3, wherein said means defining said recess includes the head of said threaded screw member and one or more threaded nuts situated on said threaded shaft between said barrel member and said head.

5. A tremolo locking device for a stringed stringed instrument of the type having a body, a plurality of tensioned strings, a tremolo plate situated in the body and including means thereon for anchoring one end of said tensioned strings; pivot means on said body for pivotally engaging said tremolo plate; counterspring means extending between a portion of said tremolo plate and said body for balancing against tension of said tensioned strings; and a tremolo arm mounted on said tremolo plate to permit a performer using said instrument to pivot said plate and thus vary the tension on said strings;

said tremolo locking device comprising;

a lower member affixed onto said body adjacent an edge of said tremolo plate, and an upper member mounted for pivotal motion on said lower member, and including means defining a recess therein to engage a rim of said tremolo plate, such that the upper member can be swung into engagement with the tremolo plate to lock said tremolo plate against movement and can be swung out of engagement therewith to permit movement of the tremolo plate;

wherein said upper member pivots on a transverse axis to swing up to engage said tremolo plate and down to disengage said tremolo plate.

6. The tremolo locking device according to claim 1, wherein said upper member pivots on an axis that is normal to the tremolo plate so as to swing in to engage and out to disengage the tremolo plate.

7. The tremolo locking device according to claim 2, wherein said lower member is in the form of a threaded screw member having a slotted head, with a slot in said head forming the hinge eye of the lower member.

* * * * *